US007837242B1

(12) United States Patent
Moscarello et al.

(10) Patent No.: US 7,837,242 B1
(45) Date of Patent: Nov. 23, 2010

(54) DEADBOLT SECURITY DEVICE

(76) Inventors: Mark Moscarello, 765 CR 13 South, St Augustine, FL (US) 32092; Ronald Kent, 5129 Gracewood La., St Augustine, FL (US) 32092; Joseph Lubrant, 1332 Pine Bloom Ct., Jacksonville, FL (US) 32259

( * ) Notice: Subject to any disclaimer, the term of this patent is extended or adjusted under 35 U.S.C. 154(b) by 0 days.

(21) Appl. No.: 12/772,596

(22) Filed: May 3, 2010

(51) Int. Cl.
*E05B 13/00* (2006.01)

(52) U.S. Cl. ..... 292/288; 70/416

(58) Field of Classification Search ..... 292/288; 70/429–430
See application file for complete search history.

(56) References Cited

U.S. PATENT DOCUMENTS 3,933,014 A * 1/1976 Moses ..... 70/416
4,279,137 A * 7/1981 Cook ..... 70/416
D334,703 S * 4/1993 Murphy ..... D8/331
D397,025 S * 8/1998 Kosi ..... D8/343
2005/0193787 A1* 9/2005 Davis ..... 70/416

* cited by examiner

*Primary Examiner*—Carlos Lugo
*Assistant Examiner*—Kristina R Fulton
(74) *Attorney, Agent, or Firm*—Lawrence J. Gibney, Jr.

(57) ABSTRACT

This is a device, which will be inserted over the doorknob and behind a deadbolt. It will prevent a deadbolt from turning in the event that someone with a key tries to enter the home or business while the space is being occupied. This device is not meant to function as a security device but only to insure greater privacy for a homeowner or business owner.

2 Claims, 5 Drawing Sheets

DEADBOLT SECURITY DEVICE

CROSS REFERENCES TO RELATED APPLICATIONS

This is an improvement of the patents that have been previously issued to the same applicants: Kent U.S. Pat. No. 7,144,052 and Kent U.S. Pat. No. 7,216,903.

BACKGROUND OF THE INVENTION

A. Field of the Invention

It is sometimes important, particularly for apartment dwellers, but also homeowners to prevent entry of an individual into the home. Most doors leading into a house or apartment have both the standard door lock as well as a deadbolt. This device would be inserted in the space between the deadbolt lock and the deadbolt plate from the inside of the door. A series of indentations or channels encircle the deadbolt handle. When the key is inserted into the deadbolt and turned this device would prevent the deadbolt from turning and unlocking the door.

B. Prior Art

Two prior patents have been issued to the inventors in this case. The first of the patents, U.S. Pat. No. 7,144,052 was a device that prevented the entry of a person from the outside of a building through the door.

The second of the patents, U.S. Pat. No. 7,216,093 was an improvement over the initial patent and incorporated a semicircular ring along the bottom edge of the top half of the device. The purpose of the ring was to insure that the top portion of the device remained over the deadbolt so that the device remained in place.

With this improvement a plurality of teeth has been placed on the ends of the raised surfaces in order to the dead bolt of the door to better grip the raised surface. Another change has been a slight widening of the circular ring in order increase the area of contact of the ring.

BRIEF SUMMARY OF THE INVENTION

This is a device, which will prevent an unnecessary or unwanted intruder from entering a home, business or apartment when it is occupied. Most doors use a deadbolt locking system and this device prevents the deadbolt from turning when the key is being used to attempt to unlock the deadbolt.

This device is particularly helpful in situations such as apartment complexes when various individuals, i.e. maintenance personnel, apartment managers etc. must access the apartment for needed repairs. This could also be used by women or the elderly as an added security measure in their homes or apartments.

Most standard apartments do not have a lock on the door knob and are only equipped with a deadbolt to secure the door. The door allows ingress and egress to the home, business or apartment while the deadbolt is the only means of providing securement of the door and a deadbolt provides more security for the door to the door jamb. The deadbolt is comprised of the lock itself, an entry point for the key, plates for the interior and exterior of the door and a deadbolt handle, which is located in the interior of the building. The deadbolt handle moves when the door is locked and unlocked. The deadbolt handle allows the homeowner to securely lock the door after entry into the apartment or home.

This device will be inserted between the inside deadbolt plate surface and the surface of the deadbolt handle, which is closest to the door. A series of indentations or channels in the device, which are angled would surround the deadbolt when the device is installed.

The device is comprised of a top portion and a bottom portion that are connected together by a pair of parallel connecting members. The device is designed to slip over the door handle when not in use.

A plurality of raised surfaces is positioned along the top portion of the device to form a series of channels or grooves into which the deadbolt handle will be inserted. The raised surfaces are of predetermined dimensions to allow the deadbolt handle to remain in the channel or groove during normal operation. A series of protrusions or teeth are positioned on the ends of the raised surfaces in order to provide a better grip of the device when it is installed.

A retaining ring on the top surface of the perimeter of the raised surfaces is provided for additional security and teeth are added to the end of the raised surfaces so that additional surface are grips the deadbolt as a further means to prevent the device from falling off the deadbolt.

The top portion is connected to the bottom portion of the device with a pair of parallel connecting members. A reinforcing member connects the two connecting members near the bottom of the top portion for additional rigidity and support.

In operation, as someone begins to turn the deadbolt from the exterior with a key the indentation or channel would prevent the deadbolt from turning the necessary number of degrees to allow the door to be unlocked. The device would use the door handle to further insure that the device would not slip off the deadbolt or door handle and prevents the deadbolt from turning.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENTS

Figure 1:
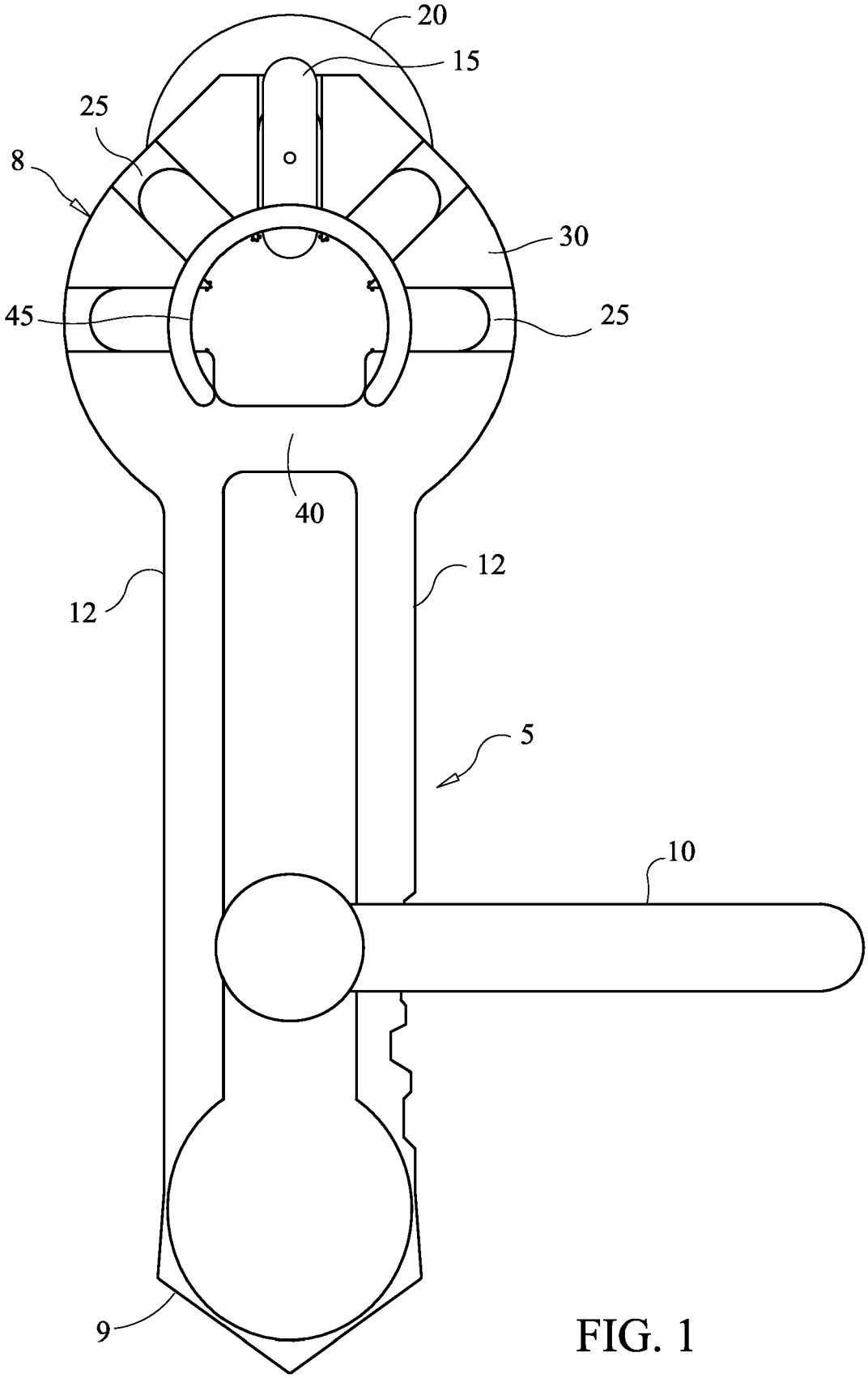
FIG. 1 is a front view of the device with the door handle, deadbolt handle and deadbolt faceplate shown with the door not shown.
Figure 2:
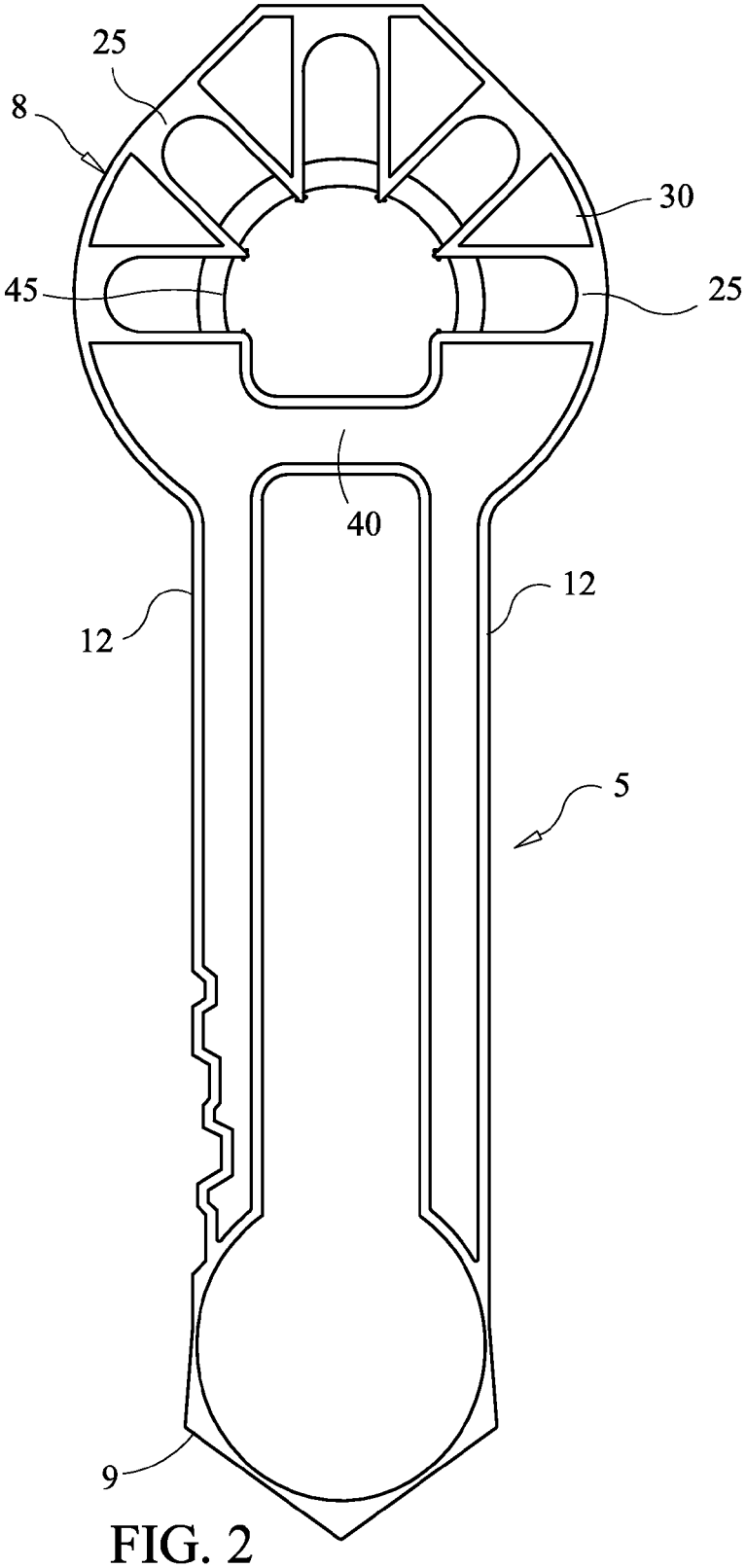
FIG. 2 is a front view of the device without the deadbolt faceplate or door.
Figure 3:
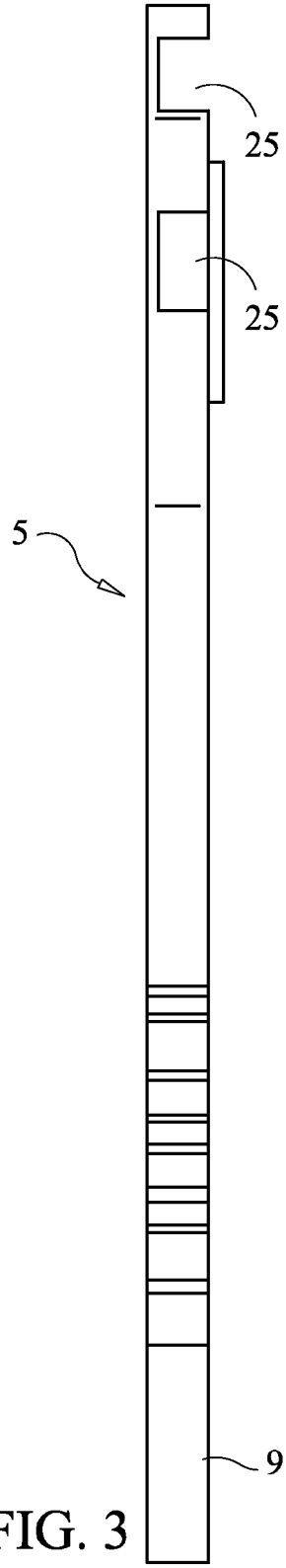
FIG. 3 is a side view of the device.
Figure 4:
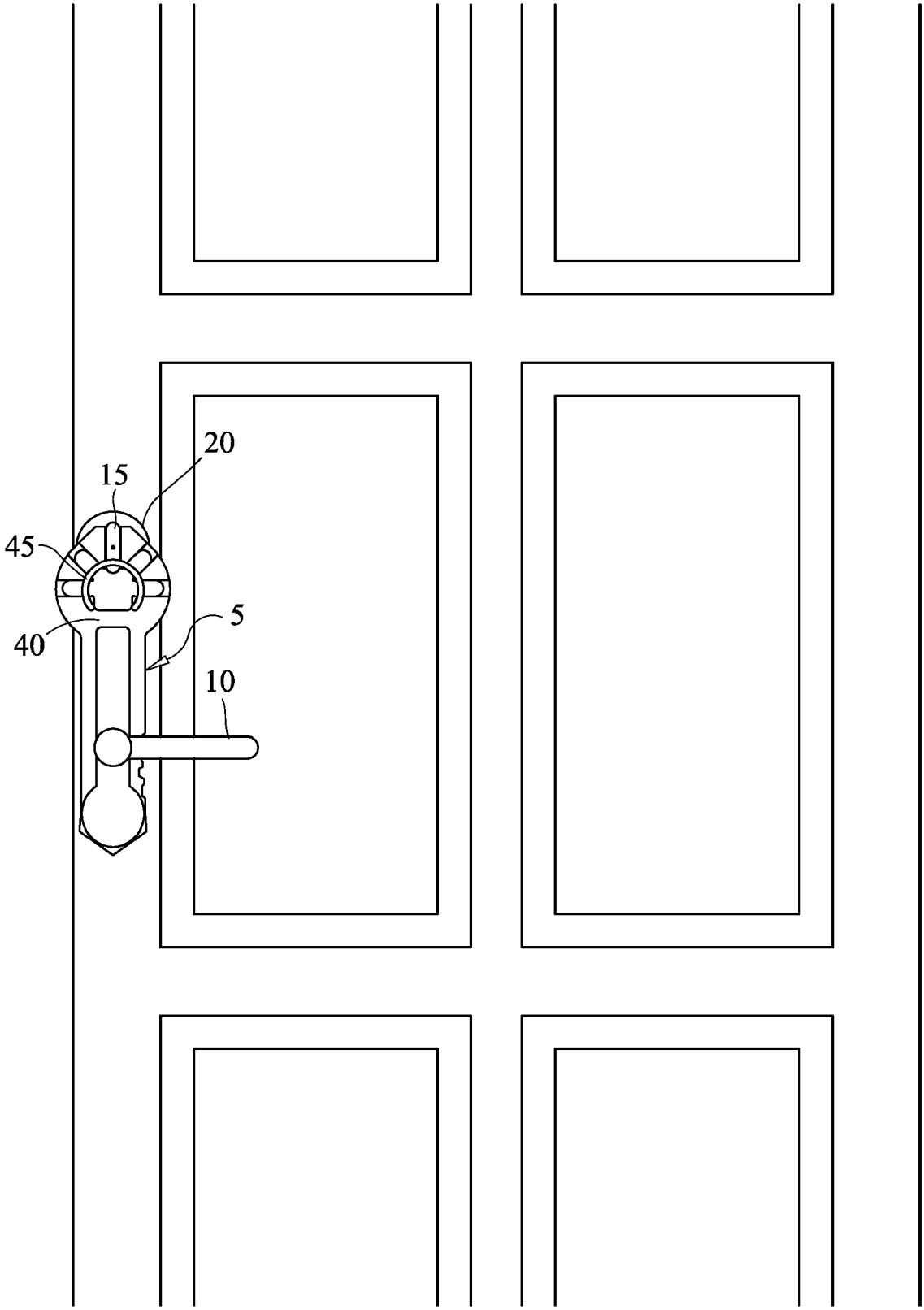
FIG. 4 is a view of the device installed on a door.
Figure 5:
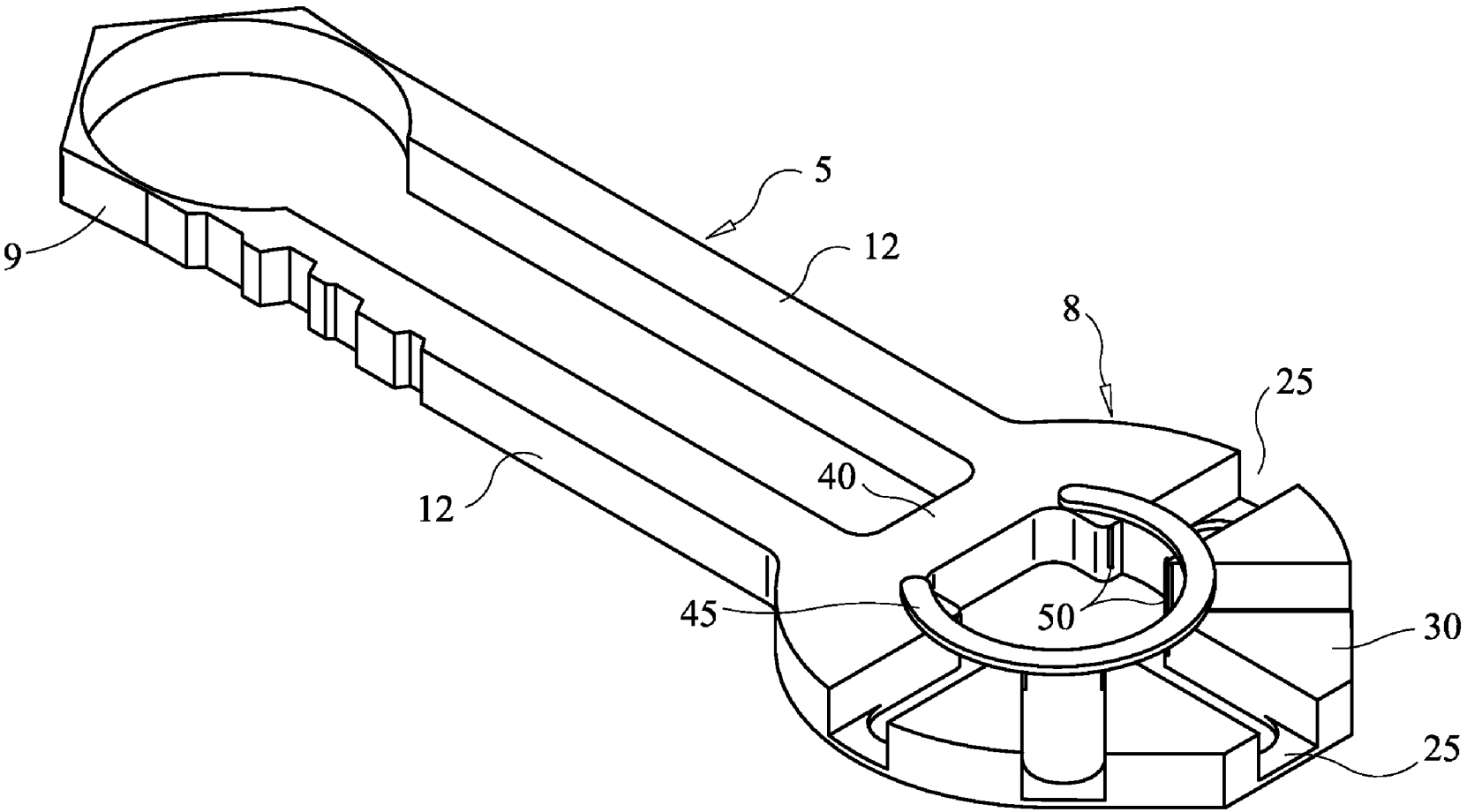
FIG. 5 is an isometric view of the device.

This device is comprised of a top section 8 that surrounds the deadbolt handle 15 of a standard deadbolt and a bottom section 9 that surrounds a door handle 10 such as depicted in FIG. 4. The top portion 8 and bottom portion 9 are essentially circular and are connected to each other by two parallel connecting members 12, which join the two circular portions of this device such as depicted in FIG. 1. The space between the two connecting members is hollow to allow the device to slip over the door handle 10 and dead bolt handle 15.

The top section 8 is flat and circular with a hole in the center of the top section, which has an outer perimeter and an inner perimeter. Openings 25 are provided along the edges of the inner and outer perimeter through which the deadbolt handle will be inserted. The deadbolt handle 15 fits within a series of channels 25, which are created by a series of raised surface 30 on the top portion of this device. The raised surfaces are of a predetermined height and extend from the inner to the outer perimeter of the top portion. The channels are wide enough to allow the deadbolt handle 15 to be inserted into the respective channel as needed. Although the device is flat with a series of channels or openings 25, it allows the deadbolt handle 15 to fit within the channels or openings 25 when it is installed such as depicted in FIGS. 1 and 4.

The indentations or channels 25, which are provided, are large enough to allow the deadbolt handle 15 to be inserted within the respective indentation or channel and allow the deadbolt handle 15 to be surrounded by enough of the surface of the raised surfaces 30 to prevent the deadbolt handle 15 from turning the required amount of degrees to open the door when a key in inserted into the key mechanism on the outside.

Figure 6:
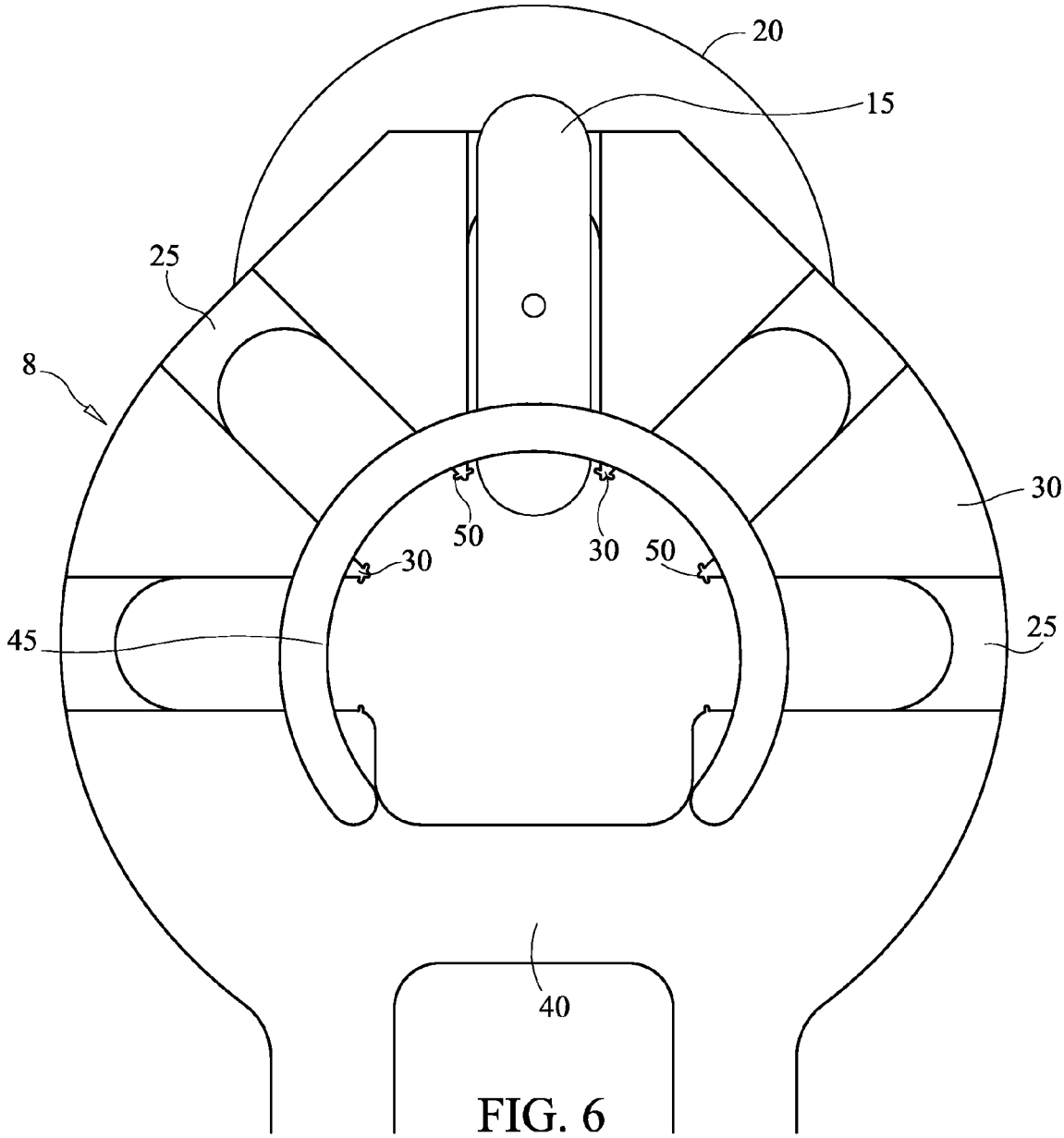
FIG. 6 is a fragmented front view of the device.
Figure 6A:
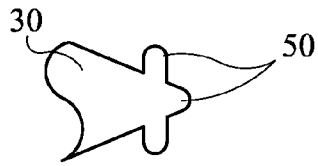
FIG. 6A is an exploded fragmented view of the end of the raised surface.

On one end of the raised surface 30 are a series of teeth 50 that extend outward at the bottom of the raised surface 30 such as depicted in FIGS. 6 and 6A. When the device is installed the teeth 50 serve to add surface area for contact with the dead bolt so that the device will not slip off the dead bolt 15.

The top portion would be installed such that it would fit between the faceplate 20 of the deadbolt and the back surface of the deadbolt handle 15. This would allow easy installation of this device and simplicity of use. No modification to the door assembly or to the deadbolt or lock of the door would be required.

A horizontal support member 40 is installed on the bottom portion of the top portion and connects a pair of connecting members 12. This horizontal member provides additional strength to the top portion. Additionally a retaining ring 45 is inserted around the inner perimeter on the top surface of the raised surfaces to provide additional strength to better insure that the device remains installed as anticipated.

Two connecting members 12 connect the top portion 8 of this device 5 to a bottom section 9 of this device 5 and form one integrated piece. These connecting members 12 are aligned essentially parallel to each other. The bottom portion 9 when the device 5 is installed surrounds the door handle 10 on the bottom. The advantage to completely surrounding the door handle 10 is to ensure that the device stays on the door and also gives an added measure of protection to the deadbolt being turned when a key is placed in the deadbolt key entry access. Additionally when it is not in use the device can simply hang from the door and always be available and easily found.

When the device is installed on the door, the top portion is placed over the deadbolt portion of the door and the bottom portion is placed over the door handle. The dead bolt handle 15 is inserted into one of the channels 25 of the top portion and a portion of the retaining ring would rest above a portion of the deadbolt handle. A portion of the deadbolt handle would extend above the level of the outer perimeter. The device 5 would rest between the deadbolt faceplate 20 and the deadbolt 15.

This device 5 is designed to be lightweight and the choice of material may include plastic, rubber, or a variety of other materials.

While the embodiments of the invention have been disclosed, certain modifications may be made by those skilled in the art to modify the invention without departing from the spirit of the invention.

The inventors claim:

1. A dead bolt security device, which is comprised of:

a. top portion;

wherein the top portion is substantially circular;

said top portion has a back surface of predetermined thickness;

wherein the top portion has an outer perimeter;

wherein openings are provided at predetermined intervals along the outer perimeter;

wherein the top portion has an inner perimeter;

wherein openings are provided at predetermined intervals along the inner perimeter;

b. bottom portion;

wherein the bottom portion is substantially circular;

wherein the bottom portion is closed;

c. connecting members;

said connecting members have a first end and a second end;

said first end is located near the top portion of the connecting member;

wherein the connecting members connect the top portion and the bottom portion;

wherein the area formed by the connecting members between the top portion and the bottom portion is hollow;

wherein the connecting members are of a predetermined width;

wherein the connecting members are of a predetermined thickness;

d. raised surfaces;

wherein a plurality of raised surfaces are positioned on the back surface of the top portion;

said raised surfaces are positioned between the inner perimeter and the outer perimeter of the top portion;

said raised surfaces have a predetermined height;

wherein the raised surfaces form channels in the top portion;

said channels extend from the inner perimeter to the outer perimeter;

wherein openings around the outer perimeter of the top portion between said plurality of raised surfaces in the top portion are provided;

e. teeth;

wherein teeth are provided on the end of the raised surfaces;

said teeth extend a predetermined distance outward from the end of the raised surface;

f. horizontal support member;

said horizontal member is placed between the connecting members near the top portion;

said horizontal member is secured to the first end of the respective connecting members;

g. retaining ring;

said retaining ring is secured to a portion of the raised surfaces;

wherein the retaining ring is of a predetermined width;

said retaining ring is positioned on the top surface of the inner perimeter of the raised surfaces.

2. The dead bolt security device as described in claim 1 wherein the raised surfaces are placed at various angles relative to the center of the top portion.

* * * * *